US006346291B2

(12) United States Patent
Matsudate et al.

(10) Patent No.: US 6,346,291 B2
(45) Date of Patent: Feb. 12, 2002

(54) METHOD OF PRODUCING A CATHODE RAY TUBE

(75) Inventors: Noriharu Matsudate, Kujukuri-machi; Ken Hashimoto, Mobara; Masahiro Nishizawa, Mobara; Masaharu Kumada, Mobara; Satoshi Muto, Mobara, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/854,570

(22) Filed: May 15, 2001

Related U.S. Application Data

(62) Division of application No. 09/070,735, filed on May 1, 1998, now Pat. No. 6,246,163, which is a continuation of application No. 08/715,463, filed on Sep. 18, 1996, now Pat. No. 5,814,928.

(30) Foreign Application Priority Data

Sep. 18, 1995 (JP) ..... 7-238713

(51) Int. Cl.[7] ..... B05D 5/12
(52) U.S. Cl. ..... 427/64; 427/68
(58) Field of Search ..... 427/64, 68

(56) References Cited

U.S. PATENT DOCUMENTS

| | | | | |
|---|---|---|---|---|
| 4,442,376 | A | 4/1984 | Van Der Waal et al. | 313/402 |
| 4,983,136 | A | 1/1991 | Okuda | 445/47 |
| 5,028,836 | A | 7/1991 | Hirasawa | |
| 5,170,093 | A | 12/1992 | Yamamoto et al. | 313/402 |
| 5,384,511 | A | 1/1995 | Fujimura | 313/402 |
| 5,686,784 | A | 11/1997 | Thomas et al. | 313/402 |

FOREIGN PATENT DOCUMENTS

| | | |
|---|---|---|
| JP | 5576553 | 6/1980 |
| JP | 62123635 | 6/1987 |
| JP | 62283526 | 12/1987 |
| JP | 6358729 | 3/1988 |
| JP | 6380438 | 4/1988 |
| JP | 63-80439 | 4/1988 |
| JP | 01024342 | 1/1989 |
| JP | 1157036 | 6/1989 |
| JP | 1204334 | 8/1989 |
| JP | 275132 | 3/1990 |
| JP | 3-17930 | 1/1991 |
| JP | 475230 | 3/1992 |
| JP | 714519 | 1/1995 |

*Primary Examiner*—Shrive P. Beck
*Assistant Examiner*—Michael Cleveland
(74) *Attorney, Agent, or Firm*—Antonelli, Terry, Stout & Kraus, LLP

(57) ABSTRACT

A cathode ray tube has a panel portion 1 with a phosphor layer 5 formed on its inner face, a neck portion 2 accommodating an electron gun 9, a funnel portion 2 for coupling the panel portion 1 to the neck portion 2 and a color selective electrode assembly 6 having a number of electron beam passing openings arranged opposite to the phosphor layer 5 with a space therebetween. The color selective electrode assembly is installed within the panel portion 1. An electron beam reflection film of a bismuth oxide thin film 6R having a bulk density of at least 1 g/cm$^3$, e.g., from 1 to 9.3 g/cm$^3$, is formed on the face of the color selective electrode assembly 6 against which the electron beams 14 emitted from the electron gun 9 collide. The cathode ray tube is capable of displaying high density and high resolution image.

8 Claims, 6 Drawing Sheets

METHOD OF PRODUCING A CATHODE RAY TUBE

This application is a Divisional application of Ser. No. 09/070,735, filed May 1, 1998, now U.S. Pat. No. 6,246,163, which is a Continuation application of Ser. No. 08/715,463, filed Sep. 18, 1996, now U.S. Pat. No. 5,814,928.

BACKGROUND OF THE INVENTION

1. Field of the Invention

The present invention relates generally to a cathode ray tube and more particularly to a cathode ray tube with an electron beam reflection film in the form of a bismuth oxide thin film having a high bulk density on the electron beam collision side of a color selective electrode assembly and a method of producing the same.

2. Description of the Prior Art

When three electron beams emitted from an electron gun in a typical cathode ray tube are projected on a phosphor layer formed on the inner face of a panel portion through electron beam passing openings of a color selective electrode assembly such as a shadow mask a pixel portion of the phosphor layer onto which the electron beams are projected becomes luminous, so that the phosphor layer as a whole displays a desired colored image.

In such an image display, the transmittance of the electron beams through the aforementioned shadow mask is of the order of from 10 to 20%. However, the electron beams which have failed to pass through the electron beam apertures of the color selective electrode assembly and collided with the color selective electrode assembly flow in the color selective electrode assembly in the form of an electric current, thus causing the color selective electrode, assembly to undergo thermal expansion because of the Joule s heat resulting from the current. As a result, the positional relationship between the color selective electrode assembly and the phosphor layer formed on the inner face of the panel portion slightly varies and the electron beams projected onto the phosphor layer commit landing errors. The landing efforts of the electron beams cause a shift in color in the display image and this phenomenon is called mask doming. Due to the mask doming thus caused in the display image on the cathode ray tube, not only the purity of color of the display image but also the white uniformity thereof may greatly deteriorate.

A known mask-doming suppressing means used in such a cathode ray tube is adapted to reducing the electron beam energy given to the color selective electrode assembly, that is, suppressing the thermal expansion of the color selective electrode assembly by employing a metal having a low thermal expansion coefficient such as invar for the color selective electrode assembly and coating the electron beam collision side of the color selective electrode assembly with an electron beam reflection film, whereby the quantity of mask doming is lowered.

There are a first, a second, a third and a fourth method of forming the aforementioned electron beam reflection film as disclosed in Japanese Patent Laid-Open Nos. 80438/1988, 80439/1988, 75132/1990 and 283526/1987, respectively.

According to the first method above, bismuth oxide ($Bi_2O_3$) put on an evaporation cell of stainless steel is subjected to radio-frequency heating, and deposited by vacuum deposition on a shadow mask.

According to the second method above, bismuth oxide ($Bi_2O_3$) on a tungsten boat is subjected to resistor heating, and deposited by vacuum deposition on a shadow mask.

According to the third method above, a sintered pellet of bismuth (Bi) powder on a tungsten boat is subjected to resistor heating and bismuth (Bi) is deposited by vacuum deposition on one side of a shadow mask as an electron beam reflection film.

According to the fourth method above, suspension of bismuth oxide ($Bi_2O_3$) powder together with slurry containing water glass acting as a binder is sprayed by means of a spray-gun so as to form a coating layer of bismuth oxide ($Bi_2O_3$) on one side of a shadow mask as an electron beam reflection film.

SUMMARY OF THE INVENTION

According to the first method, a vacuum deposition apparatus is generally complicated because a substrate is a color selective electrode assembly made of electric conductor and the mass-productivity is therefore low. According to the first method, moreover, part of bismuth oxide ($Bi_2O_3$) chemically reacts with the stainless steel of the evaporation cell since the evaporation cell of stainless steel is heated up to about 900° C. and the reaction product is simultaneously deposited on the color selective electrode assembly likewise. In an extreme case, further, the bismuth oxide ($Bi_2O_3$) chemically reacts with the stainless steel of the evaporation cell and is reduced, causing a drawback that the metal bismuth (Bi) thus reduced is also deposited on the color selective electrode assembly. As the melting point of the metal bismuth (Bi) thus deposited is low (about 270° C.), small balls of bismuth (Bi) (so-called bismuth balls) are formed on the color selective electrode assembly during the heat treatment (about 400 to 450° C.) of the process of manufacturing a cathode ray tube. Therefore, there is another problem, arising from the deterioration of the electric insulating property of such a cathode ray tube, that bismuth balls are separated by vibration and the like.

According to the second method, the heating temperature has to be higher than that in the first method since the resistor heating of the tungsten boat is used to heat the bismuth oxide ($Bi_2O_3$). The tungsten boat thus heated up chemically reacts with the bismuth oxide ($Bi_2O_3$) and raises the melting temperature, whereby substances lower in density than bismuth oxide are produced. Moreover, a highly porous bismuth oxide layer is formed because the bismuth oxide evaporated in a low vacuum region at a pressure of $10^{-2}$ Torr attracts and absorbs the residual gas such as oxygen or nitrogen and water vapor. Since impurities are thus deposited, the film structure is nonuniform, making it difficult to form a dense film and impossible to form a uniform thin film particularly when the film thickness is of the order of micrometers or lower. Consequently the electron reflection effect is greatly deteriorated. Since the tungsten boat is used to heat the bismuth oxide ($Bi_2O_3$) as in the case of the first method, part of the bismuth oxide ($Bi_2O_3$) chemically reacts with the tungsten of the evaporation boat, so that the reaction product is also deposited on the color selective electrode assembly. As in the case of the first method, further, the bismuth oxide ($Bi_2O_3$) chemically reacts with the tungsten of the evaporation boat and is reduced in an extreme case and the bismuth (Bi) thus reduced is also deposited on the color selective electrode assembly, whereby bismuth balls are formed on the color selective electrode assembly. Therefore, there has been the same problem, as what arises in the first method, that the electric insulation property of the cathode ray tube deteriorates and the bismuth balls are separated by vibrations and the like.

According to the third method of forming the electron beam reflection the melting point of the bismuth (Bi) is normally about 270° C., which is lower than the temperature of the heat treatment during the process of a manufacturing cathode ray tube. Therefore, the bismuth (Bi) film formed and deposited on one side of the color selective electrode assembly melts during the manufacturing process and due to the surface tension, the bismuth becomes spherical and is turned to bismuth balls. When the bismuth balls adhere to the electron beam passing openings of the color selective electrode assembly, the electron beam passing openings are stopped therewith, and mask aperture holding occurs in the color selective electrode assembly. The third method which is liable to cause mask aperture blocking of the color selective electrode assembly brings about pixel blemish fatal to a fine pitch color cathode ray tube that requires high density and high resolution image display. Moreover, the use of expensive sintered pellets of bismuth (Bi) produces a problem of increased cost when such an electron beam reflection film is formed.

According to the fourth method, further, the suspension of bismuth oxide ($Bi_2O_3$) is employed as a material to be sprayed when the electron beam reflection layer is formed, which makes coarser the particles of the bismuth oxide ($Bi_2O_3$) coating layer that has been formed and thicker the coating layer, whereby the shapes of the electron beam passing openings formed in the color selective electrode assembly become uneven. If the shapes of the electron beam passing openings become uneven, halation increases and the fidelity of the mask pattern lowers, whereby the purity of color and white uniformity of the display image deteriorate. The fourth method that brings about such a deterioration in characteristics still has a problem leading to performance deterioration fatal to a fine pitch color cathode ray tube that requires high density and high resolution image display.

A first object of the present invention is to provide a cathode ray tube comprising a color selective electrode assembly provided with an electron beam reflection film, and capable of high density and high resolution image display.

A second object of the present invention is to provide a method of producing a cathode ray tube comprising a color selective electrode assembly provided with an electron beam reflection film, and capable of high density and high resolution image display.

A cathode ray tube according to the present invention comprises a panel portion with a phosphor layer formed on its inner face, an electron gun for projecting electron beams toward the phosphor layer, a neck portion accommodating the electron gun, a funnel portion coupling the panel portion to the neck portion, and a color selective electrode assembly which has electron beam passing openings arranged opposite to the phosphor layer with a space therebetween, and is provided within the panel portion. An electron beam reflection film of a bismuth oxide ($Bi_2O_3$) thin film having a bulk density of at least 1 g/cm$^3$, e.g., in a range of from1 to 9.3 g/cm$^3$, more specifically, from 4 to 9.3 g/cm$^3$, is formed on the face of the color selective electrode assembly against which the electron beam collide. In the cathode ray tube according to the present invention, the bismuth oxide thin film of the electron beam reflection film is from 5 to 700 nm thick A method of producing a cathode ray tube according to the present invention comprises the steps of placing a high-density-pressed pellet of bismuth oxide ($Bi_2O_3$) powder or bismuth oxide ($Bi_2O_3$) powder on a boat of a vacuum deposition apparatus comprising a vacuum chamber, a boat whose sample stage side is made of platinum or a platinum alloy containing at least one of iridium, osmium, palladium, rhodium and ruthenium, a color selective electrode setting stage, heating means for heating the boat, and evacuation means, mounting the color selective electrode assembly on the color selective electrode setting stage, evacuating the vacuum chamber down to $10^{-4}$ Torr, vaporizing the bismuth oxide ($Bi_2O_3$) pellet or the bismuth oxide ($Bi_2O_3$) powder by use of the heating means, and depositing a bismuth oxide ($Bi_2O_3$) thin film on one side of the color selective electrode assembly as an electron beam reflection film having a bulk density of at least 1 g/cm$^3$, e.g., from 1 to 9.3 g/cm$^3$, more specifically, from 4 to 9.3 g/cm$^3$. The method of producing the cathode ray tube according to the present invention includes the step of depositing a bismuth oxide ($Bi_2O_3$) thin film on the side of the color selective electrode assembly as an electron beam reflection film having a bulk density of at least 1 g/cm$^3$, e.g., from 1 to 9.3 g/cm$^3$, more specifically from 4 to 9.3 g/cm$^3$, using a vacuum deposition apparatus equipped with a sample stage of which the sample stage side is a boat made of platinum or a platinum alloy and having a generally trapezoidal shape.

DETAILED DESCRIPTION OF THE PREFERRED EMBODIMENT

Figure 1:
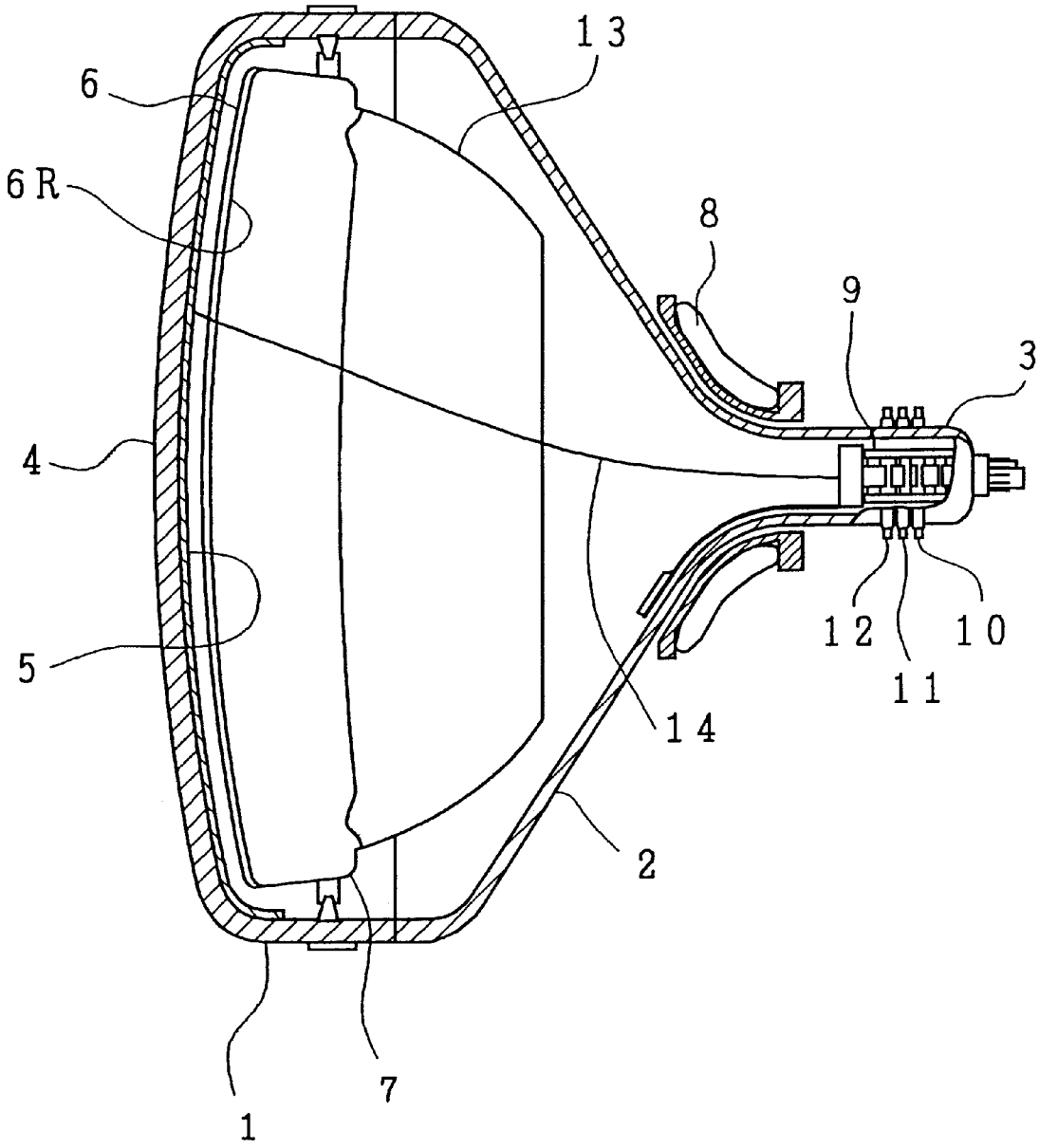
FIG. 1 is a sectional view of a cathode ray tube embodying the present invention.

A cathode ray tube according to the present invention is such that an electron beam reflection film formed on a color selective electrode assembly is a fine bismuth oxide ($Bi_2O_3$)

thin film having a thickness of from 5 to 700 nm and a bulk density of at least 1 g/cm$^3$, e.g., from 1 to 9.3 g/cm$^3$, more specifically, from 4 to 9.3 g/cm$^3$. Therefore, the color selective electrode assembly is free from mask aperture blocking due to bismuth balls. Since the electron beam reflection film of the cathode ray tube according to the present invention is a bismuth oxide ($Bi_2O_3$) thin film having a bulk density of at least 1 g/cm$^3$, e.g., from 1 to 9.3 g/cm$^3$, more specifically, from 4 to 9.3 g/cm$^3$, the shapes of the electron beam passing openings in the color selective electrode assembly are prevented from becoming nonuniform even in the case where the thickness of the electron beam reflection film is not greater than 1% of the plate thickness of the color selective electrode assembly, which has hardly been attainable in the prior art. Since the electron beam reflection film of the cathode ray tube according to the present invention is a bismuth oxide ($Bi_2O_3$) thin film having a bulk density of at least 1 g/cm$^3$, e.g., from 1 to 9.3 g/cm$^3$, more specifically, from 4 to 9.3 g/cm$^3$, further, the cathode ray tube is a fine pitch color cathode ray tube capable of providing high density and high resolution image display without fatal performance deterioration such as pixel blemish.

A method of producing a cathode ray tube, using a boat of platinum (Pt) or a platinum (Pt) alloy or preferably an iridium-platinum (Ir—Pt) alloy for a vacuum deposition apparatus for use in forming an electron beam reflection film on a color selective electrode assembly, comprises the steps of putting a high-density-pressed pellet of bismuth oxide ($Bi_2O_3$) powder or bismuth oxide ($Bi_2O_3$) powder on the boat and evacuating the aforementioned vacuum chamber down to $10^{-4}$ Torr so as to vapor-deposit the electron beam reflection film on the color selective electrode assembly. Since the bismuth oxide ($Bi_2O_3$) pellet or bismuth oxide ($Bi_2O_3$) powder is uniformly heated on the boat, it is possible to raise the deposition rate of the bismuth oxide. Moreover, an electron beam reflection film of a homogeneous bismuth oxide ($Bi_2O_3$) thin film having a high bulk density can be formed on the color selective electrode assembly because the boat of platinum (Pt) alloy does not chemically react with bismuth oxide ($Bi_2O_3$). In addition, not only the generation of halation but also shape degradation of the electron beam passing openings of the color selective electrode assembly is prevented, whereby mask doming is suppressed from occurring. The electron beam reflection film can be formed at a lower cost because the high-density-pressed pellet of bismuth oxide ($Bi_2O_3$) powder is less expensive than the sintered pellet of bismuth (Bi) powder.

A detailed description will subsequently be given of an embodiment of the present invention with reference to the accompanying drawings.

(Embodiment)

FIG. 1 is a sectional view showing the overall structure of a cathode ray tube embodying the present invention.

In FIG. 1, reference 1 denotes a panel portion; 2, a funnel portion; 3, a neck portion; 4, a face plate; 5, a phosphor layer; 6, a color selective electrode assembly; 6R, an electron beam reflection film; 7, a mask frame; 8, a deflection yoke assembly; 9 an electron gun; 10, a purity adjustment magnet assembly; 11, a center electron beam static convergence adjustment magnet assembly; 12 a side electron beam static convergence adjustment magnet assembly; 13, a magnetic shield; 14, an electron beam.

A tube body constituting a cathode ray tube includes the panel portion 1 placed on the front side, the neck portion 3 accommodating the electron gun 9 and the funnel portion 2 provided between the panel portion 1 and the neck portion 3. The panel portion 1 is equipped with the face plate 4 on the front panel and the phosphor layer 5 is deposited on the inner face of the face plate 4. The mask frame 7 is securely disposed on inner the peripheral edge of the panel portion 1, which is used to fix the color selective electrode assembly 6 opposite to the phosphor layer 5. The electron beam reflection film 6R made of bismuth oxide ($Bi_2O_3$) is formed on the color selective electrode assembly 6 with which the electron beam 14 emitted from the electron gun 9 collides. The magnetic shield 13 is provided on the inner side of the joint portion between the panel portion 1 and the funnel portion 2, whereas the deflection yoke assembly 8 is provided on the outer side of the joint portion between the funnel portion 2 and the neck portion 3. The purity adjustment magnet assembly 10, the center electron beam static convergence adjustment magnet assembly 11 and the side electron beam static convergence adjustment magnet assembly 12 are arranged side by side outside the neck portion 3, so that the three electron beams 14 (only one is shown) emitted from the electron gun 9 are deflected by the deflection yoke assembly 8 in a predetermined direction and projected onto the phosphor layer 5 through the color selective electrode assembly 6.

Figure 2:
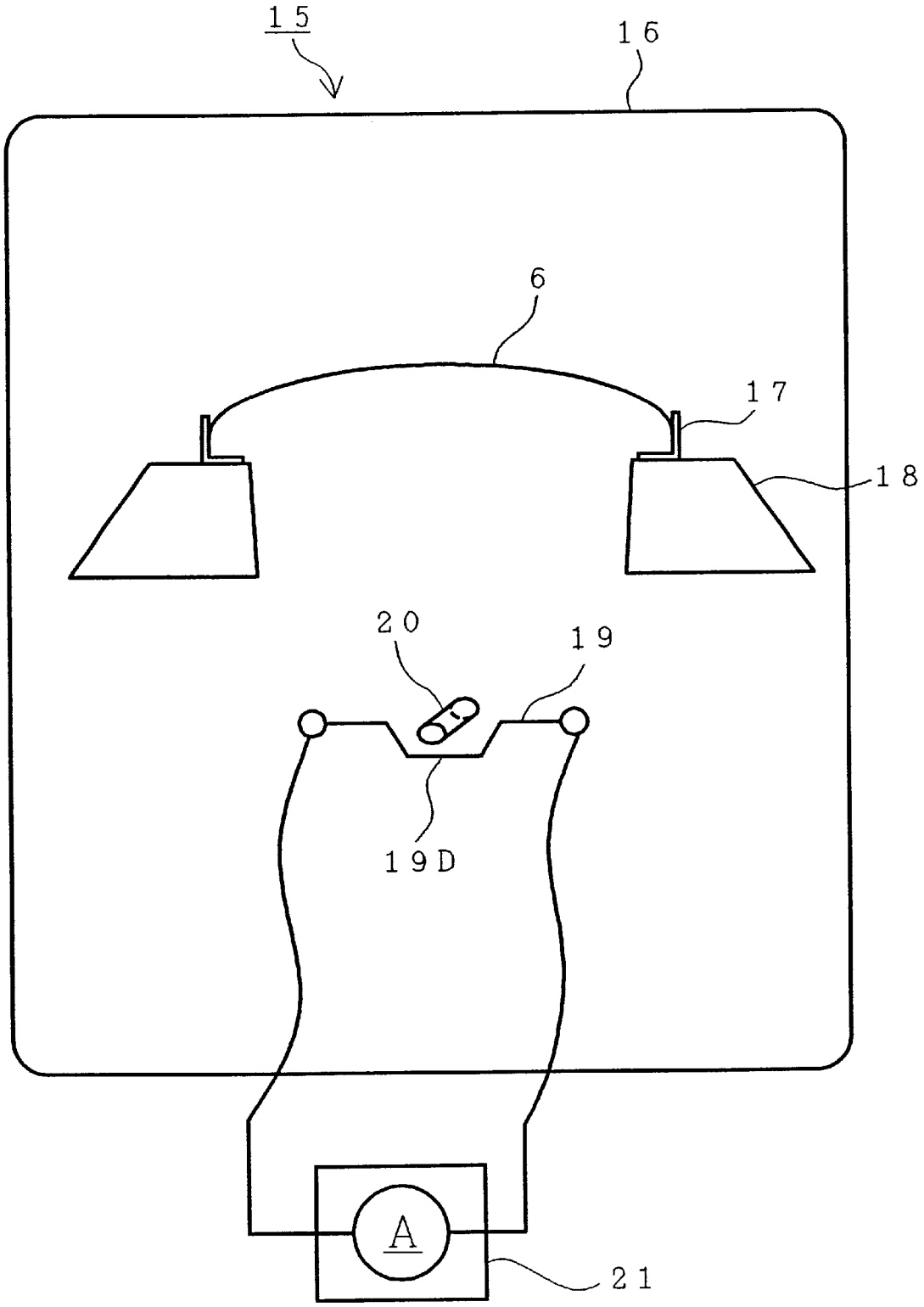
FIG. 2 is a sectional block diagram of a vacuum deposition apparatus used when a bismuth oxide thin film is formed of an electron beam reflection film on a color selective electrode assembly of the cathode ray tube of the embodiment according to the present invention.

FIG. 2 is a sectional block diagram of a vacuum deposition apparatus for forming a bismuth oxide ($Bi_2O_3$) thin film of the electron beam reflection film 6R on the color selective electrode assembly 6 of the cathode ray tube according to the present invention.

In FIG. 2, reference numeral 15 denotes a vacuum deposition apparatus; 16, a vacuum chamber; 17, a color selective electrode setting stage; 18, a support stage; 19, an iridium-platinum (Ir—Pt) alloy boat; 19D, a trapezoidal evaporation sample stage; 20, a high-density-pressed pellet of bismuth oxide ($Bi_2O_3$) powder; 21, a power source. Like reference characters are given to like component parts of FIG. 1.

In the vacuum chamber 16, the shadow mask setting stage 17, the support stage 18 and the iridium-platinum (Ir—Pt) alloy boat 19 are arranged, constituting the vacuum deposition apparatus 15 as a whole. The color selective electrode assembly 6 is mounted on the color selective electrode setting stage 17 with its face for receiving electron beams down, and the color selective electrode setting stage 17 is disposed on the support stage 18. The iridium-platinum (Ir—Pt) alloy boat 19 is provided with the sample stage 19D in its central part and the high-density-pressed pellet 20 of bismuth oxide ($Bi_2O_3$) powder is placed on the evaporation sample stage 19D. Both ends of the iridium-platinum (Ir—Pt) alloy boat 19 are connected to the power source 21 and the evaporation sample stage 19D is heated when the boat is supplied with power from the power source 21.

Figure 3:
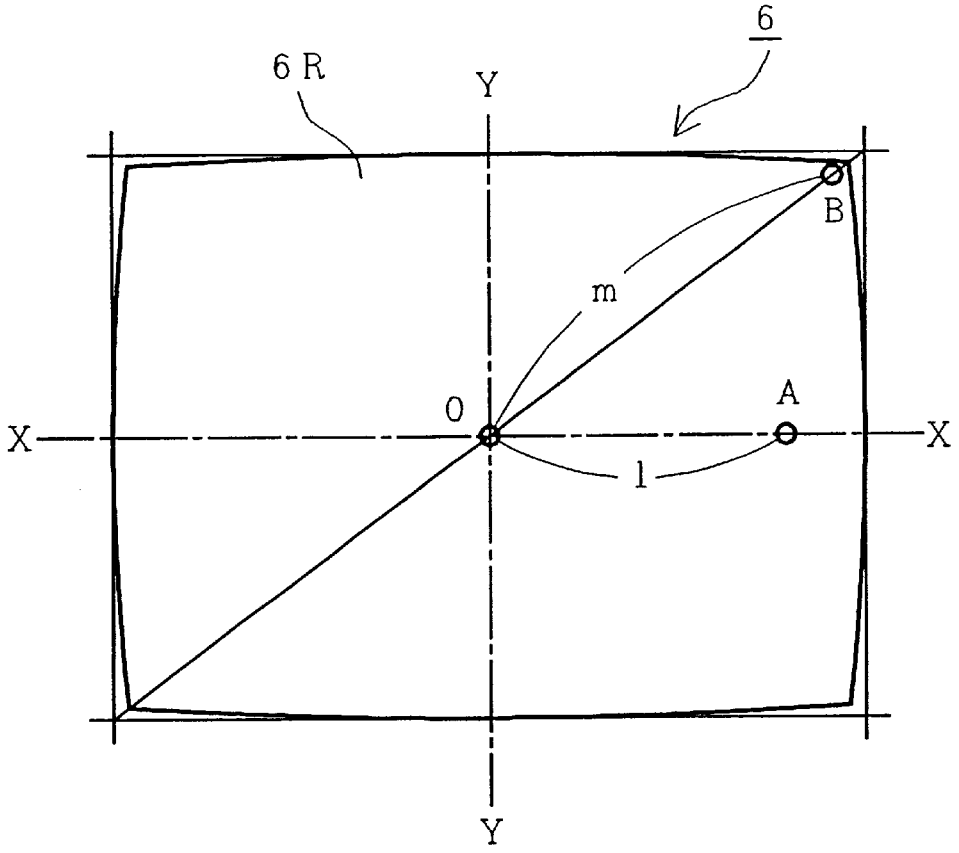
FIG. 3 is a diagram illustrating the portion where the thickness of the bismuth oxide thin film formed on the color selective electrode assembly of the cathode ray tube of the embodiment according to the present invention is measured.

The electron beam reflection film of the cathode ray tube according to the present invention was prepared as follows: The vacuum chamber 16 was vented to atmosphere and the high-density-pressed pellet 20 of bismuth oxide ($Bi_2O_3$) powder was placed on the evaporation sample stage 19D of the iridium-platinum (Ir—Pt) alloy boat 19 in the vacuum chamber 16. Subsequently, a 50 to 300 $\mu$m thick color selective electrode assembly 6 of iron-nickel (Fe—Ni) alloy with its surface subjected to blacken treatment was mounted on the color selective electrode setting stage 17. In this case, a high-density-pressed pellet 20 of bismuth oxide ($Bi_2O_3$) powder having a mean particle size of 1 pm and weighing about 500 mg was employed by way of example. While the vacuum chamber 16 was being evacuated by means of a vacuum pump (not shown) so that the residual gas pressure therein lowered to $2\times10^{-4}$ Torr or lower, the evaporation sample stage 19D was preheated by applying 800 W of power from the power supply 21 to the iridium-platinum (Ir—Pt) alloy boat 19 for 10 seconds so as to melt the bismuth oxide ($Bi_2O_3$). Further, the power was increased up to 2.3 kW and the evaporation sample stage 19D was heated for 10 seconds thereby to vaporize the bismuth oxide ($Bi_2O_3$). Hence a bismuth oxide ($Bi_2O_3$) thin film having a thickness of 30 nm and a bulk density of about 8.6 g/cm$^3$, for example, was deposited on the electron-beam-receiving face of the color selective electrode assembly 6. Then a fight interference film thickness meter Model 100 of Sloan Co., the United States, was used to measure the thickness of the bismuth oxide ($Bi_2O_3$) thin film. FIG. 3 shows the part where the thickness of the bismuth oxide ($Bi_2O_3$) thin film deposited on a color selective electrode assembly 6 was measured, the part having an aspect ratio of 3:4 and a diagonal of 51 cm, in other words, the short side is 30.6 cm and the long side is 40.8 cm. As shown in FIG. 3, the thickness of the bismuth oxide thin film 6R on the color selective electrode assembly 6 was measured at three points: the central point O; point A at a distance of 17 cm (1=17 cm) from the central point O in the direction parallel to the long side (X-X direction), that is, 83% of a half length of the long side (20.4 cm); and point B at a distance of 23 cm (m=23 cm) from the central point O on the diagonal line, that is, 90% of a half length of the diagonal line (25.5 cm) in order to obtain a mean value of them. In the case of a color selective electrode assembly whose aspect ratio or diagonal length is different from the one above, the thickness of the bismuth oxide film can be obtained by averaging the values of the central point and 83% of a half length of the long side and 90% of a half length of the diagonal line. For the measurement, an optical microscope or a scanning electron microscope (SEM) may be used to find the thickness of the bismuth oxide ($Bi_2O_3$) thin film 6R by observing the cross section. Further, the bulk density of the bismuth oxide ($Bi_2O_3$) thin film 6R was found by calculation from the mass, measured by a balance, of the deposited film of the bismuth oxide ($Bi_2O_3$) in a predetermined area and the volume of the deposited film of the bismuth oxide ($Bi_2O_3$) found from the film thickness and the area mentioned above.

Although a description of this embodiment has been given of a case where the iridium-platinum (Ir—Pt) alloy boat 19 was used on which the deposition sample was placed, materials of the boat 19 according to the present invention is not limited to the iridium-platinum (Ir—Pt) alloy but may include platinum (Pt) alone or a platinum (Pt) alloy such as an alloy of platinum (Pt) and one of osmium (Os), palladium (Pd), rhodium (Rh) and ruthenium (Ru). The boat 19 may be any one so long as the surface thereof on which a sample is placed is covered with platinum or a platinum alloy. As long as this condition is met, the heating method is not restricted to the resistor heating but use can be made of another heating means employing radio-frequency heating, infrared heating, electron beam heating or the like.

Although a description of this embodiment has been given of a case where the high-density-pressed pellet 20 of bismuth oxide ($Bi_2O_3$) powder is employed as a deposition sample which has an excellent workability and is suitable for automated production, the deposition sample is not restricted to the form of a pellet but bismuth oxide ($Bi_2O_3$) powder as it is can be used.

Figure 4:
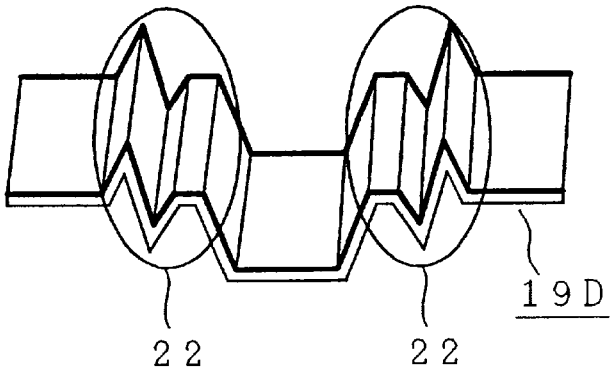
FIG. 4 is a schematic diagram of an evaporation sample stage of a vacuum deposition apparatus used when a bismuth oxide thin film of the electron beam reflection film is formed on the color selective electrode assembly of the cathode ray tube of the embodiment according to the present invention.

With respect to the generally trapezoidal evaporation sample stage 19D of this embodiment, a wave shaped portion 22 for absorbing thermal expansion as shown in FIG. 4, for example, may be installed at a place where the deposition sample is not placed, so that expansion-contraction mechanical stress is absorbable thereby.

Figure 5:
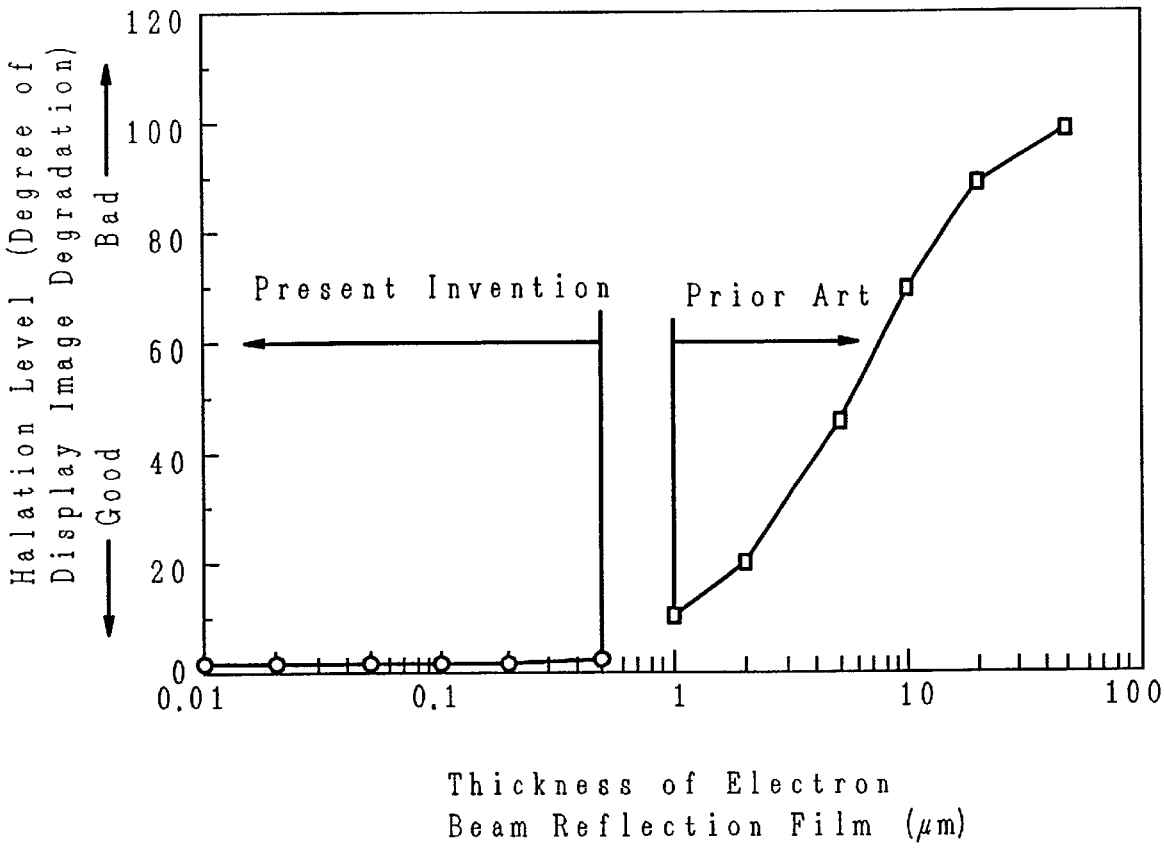
FIG. 5 is a characteristic diagram illustrating the relationship between the thickness of the electron beam reflection film formed on the color selective electrode assembly of the cathode ray tube and the halation level (degree of display image degradation) of the cathode ray tube of the embodiment according to the present invention.

FIG. 5 is a characteristic diagram illustrating the relationship between the thickness of the electron beam reflection film formed on the color selective electrode assembly and the halation level (degree of display image degradation) of the cathode ray tube. The halation level of the cathode ray tube was found by measuring the chromaticity of a red monochromatic color. More specifically, the red monochromatic color was displayed on the phosphor layer of a color cathode ray tube and the x, y chromaticities of C.I.E. (Commission International de l'Eclairage) were measured by means of a spectrophotometer so as to obtain a value z from equation (1).

$$z=1-(x+y) \tag{1}$$

Similarly, the value $z_o$ of the color selective electrode assembly with no electron, beam reflection film was used to obtain the value of the halation level from equation (2).

$$H=((z-z_o)/z_o)\times100 \tag{2}$$

In the equation (2), the closer the value H is to 0, the smaller and better 2 5 the halation level is.

Figure 6:
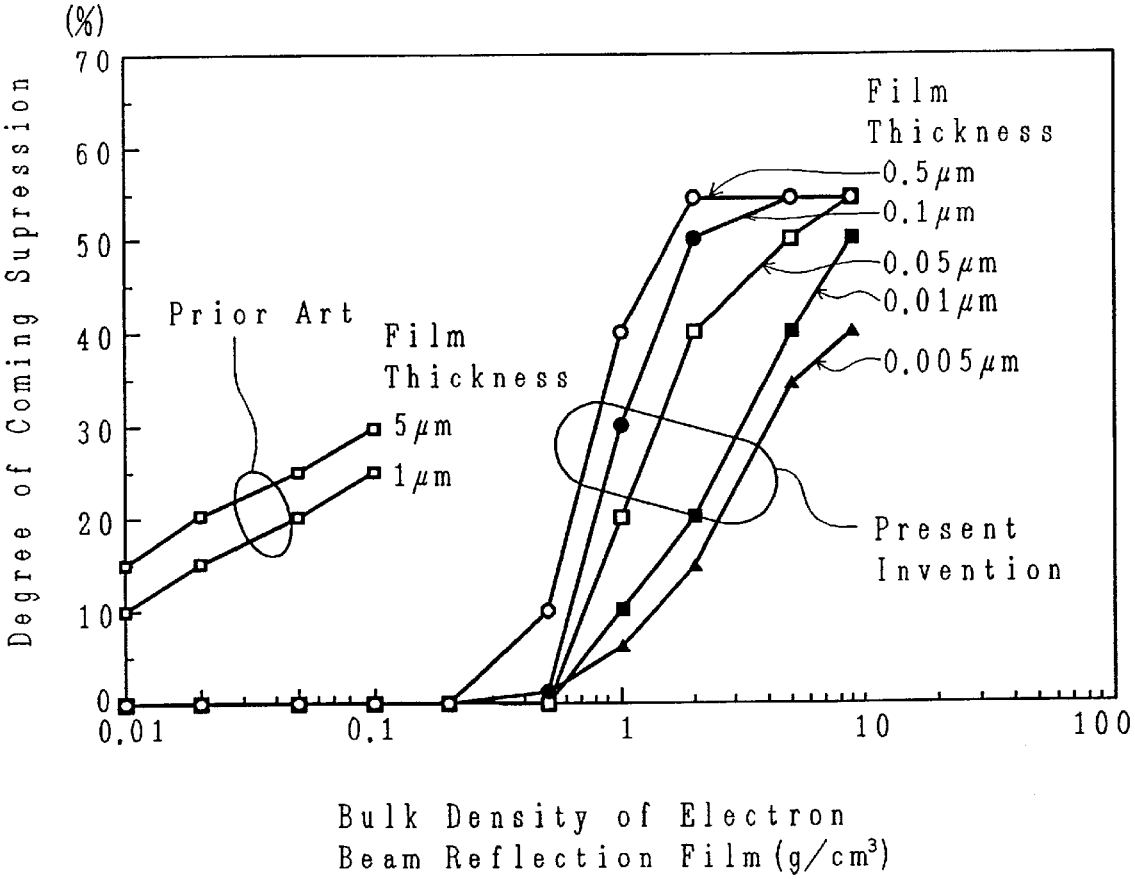
FIG. 6 is a characteristic diagram illustrating the relationship between the bulk density of the electron beam reflection film formed on the color selective electrode assembly of the cathode ray tube and the degree of doming suppression of the cathode ray tube of the embodiment according to the present invention.

FIG. 6 is a characteristic diagram illustrating the relationship between the bulk density of the electron beam reflection film formed on the color selective electrode assembly and the degree of doming suppression. The bulk density of the electron beam reflection film was varied by changing the deposition rate when the bismuth oxide was deposited and the residual gas pressure in the vacuum deposition apparatus. The bulk density is low when the deposition rate is low and when the residual gas pressure is high. As seen in FIG. 6, the present invention has a reflection film that has a relatively high bulk density (e.g., at least 1 g/cm$^3$, for example, a bulk density in a range of 1–9.3 g/cm$^3$). The degree of doming suppression was found by measuring the movement of the electron beam on the phosphor layer 5 of the cathode ray tube with no electron beam reflection film on the color selective electrode assembly and the movement of the electron beam on the phosphor layer 5 in the cathode ray tube with an electron beam reflection film thereon by means of a microscope. In other words, the movement of the electron beam is measured by the microscope after the phosphor layer of the cathode ray tube was excited by a predetermined current for a predetermined time. Subsequently, the reduced quantity of the movement of the electron beam in the cathode ray tube with the electron beam reflection film relative to the movement of the electron beam in the cathode ray tube with no electron beam reflection film is expressed in percentage. The greater this value, that is, the degree of doming suppression, the better.

Figure 7:
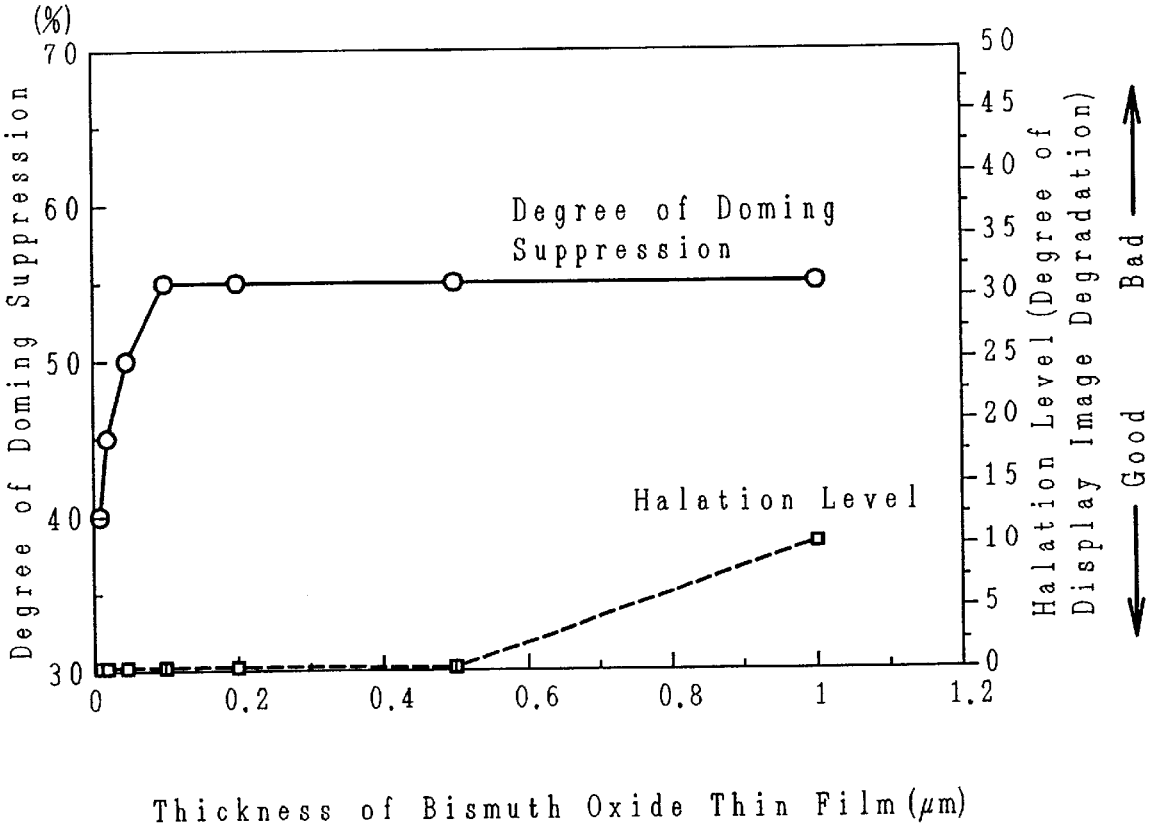
FIG. 7 is a characteristic diagram illustrating the relationship between the thickness of the bismuth oxide thin film formed on the color selective electrode assembly of the cathode ray tube and the halation level (degree of display image degradation), and the relationship between the thickness and the degree of doming suppression of the cathode ray tube of the embodiment according to the present invention.

FIG. 7 is a characteristic diagram illustrating the relationship between the thickness of the bismuth oxide ($Bi_2O_3$) thin film 6R having a bulk density of 7 g/cm$^3$ formed on the color selective electrode assembly and the halation level (degree of display image degradation) and the degree of doming suppression, in the embodiment of the present invention.

FIG. 5 shows the halation level of a cathode ray tube with an electron beam reflection film having a bulk density of 7 g/cm$^3$ of this embodiment and that of a cathode ray tube having an electron beam reflection film having a bulk density of 0.1 g/cm$^3$ formed by a powder spray method disclosed in Japanese Patent Laid-Open No. 123635/1987. As shown in FIG. 5, the halation level (degree of display image degradation) of the cathode ray tube with a electron beam reflection film of this embodiment substantially remains at a lower level and therefore is extremely satisfactory. Whereas the halation level (degree of display image degradation) of the cathode ray tube with a electron beam reflection film of the prior art is high and besides neither the thickness of the electron beam reflection film could be decreased to below 1 $\mu$m nor the bulk density could be increased through the conventional technique.

In this embodiment, since the thickness of the electron beam reflection film, that is, the bismuth oxide ($Bi_2O_3$) thin film 6R can easily be set in a range of from 5 to 700 nm, it is possible to manufacture an excellent cathode ray tube which is low in halation level (degree of display image degradation) as shown in FIG. 5. Incidentally, the electron beam reflection film prepared by the powder spray method exhibits a bulk density of as low as 0.1 g/cm$^3$ because bismuth oxide ($Bi_2O_3$) powder is sprayed and besides the film becomes porous when its thickness is 1 pm or less, whereby the incident electron beam is allowed to pass through bismuth oxide ($Bi_2O_3$) particles without being reflected from the film. For this reason, it is possible to realize only a cathode ray tube whose degree of doming suppression and halation level (degree of display image degradation) are low as shown in FIG. 5.

As shown in FIG. 6, the degree of doming suppression increases as the bulk density of the electron beam reflection film increases. When the electron beam reflection film 6R, that is, the bismuth oxide ($Bi_2O_3$) thin film formed on the color selective electrode assembly 6 of the cathode ray tube of this embodiment is from 5 to 700 nm thick, the bulk density can be set in a range of from 4 to 9.3 g/cm$^3$ (the mass of the electron beam reflection film per unit area is in a range of from $2\times10^{-6}$ to $6.5\times10^{-4}$ g/cm$^2$). It is therefore possible, as in this embodiment of the invention, to manufacture a cathode ray tube whose degree of doming suppression is 30% or higher as shown in FIG. 6.

When the bismuth-to-oxygen molar ratio of the bismuth oxide deposited was analyzed through an SEM-WDX (Scanning Electron Microscope-Wavelength Dispersive X-ray Spectrometer) analysis method (using Model SEM-WDX 650 of Hitachi, Ltd.) at the same points where the film thickness was measured, the average amount of bismuth was found in a range of from 0.5 to 0.7 mol to one mol of oxygen, that is, this value agrees closely with the theoretical value (0.67 mol). Incidentally, the bulk density of the electron beam reflection film produced through the known powder spray method cannot exceed 0.1 g/cm$^3$ and as shown in the characteristic diagram of FIG. 6, the degree of doming suppression does not exceed 30%. Although analysis of the impurities contained in the electron beam reflection film according to the present invention was further made by the SEM-EDX (Scanning Electron Microscope-Energy Dispersive X-ray Spectrometer) analysis method, the components attributed to the deposition boat was found lower than the identification limit (1 ppm) of the analytical instrument.

The thickness of the electron beam reflection film 6R, that is, the bismuth oxide ($Bi_2O_3$) thin film formed on the color selective electrode assembly 6 of the cathode ray tube of the embodiment is so determined on the basis of the results obtained as mentioned above that it ranges from 5 to 700 nm. As a result, the degree of doming suppression can be made not lower than 30% as shown in FIG. 7, and hence an excellent cathode ray tube such that the halation level (degree of display image degradation) is substantially the same as that of a color selective electrode assembly with no electron beam reflection film can be produced.

Since the bismuth oxide ($Bi_2O_3$) thin film of the electron beam reflection film 6R is formed on the electron-beam-receiving face of the color selective electrode assembly 6, a cathode ray tube of this embodiment free from mask aperture blocking, deformation of the electron beam passing openings and fatal pixel blemishes and capable of displaying a high density and high definition image.

According to the method of producing the cathode ray tube of this embodiment, further, the iridium-platinum (Ir—Pt) alloy boat 19 and the high-density-pressed pellet 20 of bismuth oxide ($Bi_2O_3$) powder are used when the bismuth oxide ($Bi_2O_3$) thin film of the electron beam reflection film 6R is formed on the electron-beam-receiving face of the color selective electrode assembly 6, so that the pellet 20 is uniformly heated on the boat 19 and the deposition rate is improved. Since the pellet 20 does not chemically react with the boat 19, an electron beam reflection film 6R of a homogenous bismuth oxide ($Bi_2O_3$) thin film having a high bulk density can be formed on the color selective electrode assembly 6.

As set forth above, according to the present invention, since an electron beam reflection film formed on the color selective electrode assembly is a bismuth oxide ($Bi_2O_3$) thin film having a bulk density of at least 1 g/cm$^3$, e.g., in a range of 1–9.3 g.cm$^3$, more specifically, from 4 to 9.3 g/cm$^3$, a fine pitch color cathode ray tube capable of displaying a high density and high resolution image is available, which cathode ray tube is free from mask aperture blocking of the color selective electrode assembly due to the formation of bismuth balls, unevenly-shaped electron beam passing openings of the color selective electrode assembly because of coarse particles of the electron beam reflection film and greater thickness of the film, and fatal deterioration in performance. Moreover, the electron beam reflection can be produced less costly because the high-density-pressed pellet of bismuth oxide ($Bi_2O_3$) powder is cheaper than the sintered pellet of bismuth (Bi) powder.

According to the present invention, further, the iridium-platinum (Ir—Pt) alloy boat and the high-density-pressed pellet of bismuth oxide ($Bi_2O_3$) powder are employed in the vacuum deposition apparatus for use in forming the electron beam reflection film of the color selective electrode assembly, and when the electron beam reflection film is deposited on the color selective electrode assembly, the pellet of bismuth oxide ($Bi_2O_3$) powder is uniformly heated without chemically reacting therewith, so that the deposition rate is improved. Thus an electron beam reflection film of a homogenous bismuth oxide ($Bi_2O_3$) thin film having a high bulk density can be formed on the color selective electrode assembly. Moreover, generation of halation and degradation of the shape of the electron beam passing openings of the cathode ray tube using the color selective electrode assembly manufactured by the vacuum deposition apparatus are prevented, suppressing the mask doming.

What is claimed is:

1. A method of producing a cathode ray tube comprising a panel portion with a phosphor layer formed on its inner face, a neck portion accommodating an electron gun, a funnel portion for coupling said panel portion to said neck portion, and a color selective electrode having electron beam passing openings arranged opposite to said phosphor layer with a space therebetween, comprising the step of depositing a bismuth oxide layer on an electron gun side of said color selective electrode by vacuum evaporation, evaporated from an evaporation boat made of platinum or an alloy of platinum with one selected from the group consisting of iridium, osmium, palladium. rhodium, or rubidium.

2. A method of producing a cathode ray tube according to claim 1, wherein said evaporation boat is made of platinum alloy.

3. A method of producing a cathode ray tube according to claim 1, wherein said evaporation boat is made of platinum-iridium alloy.

4. A method of producing a cathode ray tube according to claim 1, wherein said evaporation boat is made of an alloy of platinum and one selected from the group consisting of osmium, palladium, rhodium, and ruthenium.

5. A method of producing a cathode ray tube according to claim 1, wherein bulk density of said bismuth oxide layer is between 1 $g/cm^3$and 9.3 $g/cm^3$.

6. A method of producing a cathode ray tube according to claim 1, wherein bulk density of said bismuth oxide layer is between 4 $g/cm^3$ and 9.3 $g/cm^3$.

7. A method of producing a cathode ray tube according to claim 1, wherein the bismuth to oxygen atomic molar ratio of said bismuth oxide layer is 0.5:1.0 to 0.7:1.0.

8. A method of producing a cathode ray tube according to claim 1, wherein said color selective electrode is made of iron-nickel alloy.

* * * * *